US005410111A

United States Patent [19]

Stief et al.

[11] Patent Number: 5,410,111

[45] Date of Patent: Apr. 25, 1995

[54] HOUSING LINING

[75] Inventors: Reinhard Stief, Weinheim; Gerhard Müller-Broll, Rimbach; Thomas Jost, Weinheim; Manfred Mattutat, Ladenburg; Klaus-Dieter Schmitt, Gorxheimertal, all of Germany

[73] Assignee: Firma Carl Freudenberg, Weinheim, Germany

[21] Appl. No.: 190,406

[22] Filed: Feb. 2, 1994

[30] Foreign Application Priority Data

Feb. 16, 1993 [DE] Germany ..... 43 04 628.2

[51] Int. Cl.[6] ..... E04B 1/82

[52] U.S. Cl. ..... 181/286; 181/293

[58] Field of Search ..... 181/204, 205, 208, 207, 181/284, 286, 288, 290, 291, 293, 295

[56] References Cited

U.S. PATENT DOCUMENTS

| | | | |
|---|---|---|---|
| 4,242,398 | 12/1980 | Segawa et al. | 181/284 X |
| 4,420,526 | 12/1983 | Schilling et al. | 181/293 X |
| 4,584,232 | 4/1985 | Frank et al. | 181/288 X |
| 4,715,473 | 12/1987 | Tschudin-Mahrer | 181/286 |
| 4,867,271 | 9/1989 | Tschudin-Mahrer | 181/286 |
| 5,298,694 | 3/1994 | Thompson et al. | 181/286 |

FOREIGN PATENT DOCUMENTS 3621658 1/1988 Germany .

*Primary Examiner*—Khanh Dang
*Attorney, Agent, or Firm*—Kenyon & Kenyon

[57] ABSTRACT

A housing lining is disclosed with a self-supporting and airborne sound-absorbing layer of fibers. The fibers are compressed and glued together at least in the region of the edge surrounding the layer on the outside, to form an essentially pore-free supporting frame. The supporting frame may be provided with a cup-shaped bulge which comprises sound absorption surfaces which have a sound impedance of 20 to 200 Rayl.

9 Claims, 4 Drawing Sheets

HOUSING LINING

BACKGROUND OF THE INVENTION

1. Field of the Invention

The present invention relates to a housing lining which includes a self-supporting and air-filled sound-absorbing fiber layer.

2. Description of Related Art

A housing lining is shown in DE-OS 36 21 658. In the housing lining of the above publication, random fiber materials are mixed with binders and are compressed into a lattice by the application of pressure and heat. The result is a self-supporting unit. The housing lining described in that publication has cushion-shaped individual elements which are compacted in a manner which increases from the center of the elements towards their edges. The dimensional stability of the housing lining in this device, is achieved at the expense of the sound absorption capabilities for higher frequencies, since the areas of weakly compressed fibers are relatively small. In order to avoid this disadvantage, it is proposed to arrange several layers of this housing linings on top of each other. This arrangement, however, requires a relatively large amount of space.

SUMMARY OF THE INVENTION

It is the object of the present invention to develop a housing lining so as to cover the same area as the device described above, and also to increase the absorption area of the lining and to improve the sound absorption of the lining, particularly for low frequency vibrations.

In the present invention the fibers of the lining are compressed and glued together in the region of the edge surrounding the layer, so as to form a essentially pore-free supporting frame. The supporting frame is provided with a cup-shaped bulge and that the bulge is limited by absorption surfaces which have a sound impedance of 20–200 Rayl. One Rayl corresponds to 10 $Ns/m^3$. Due to the compressed and glued together supporting frame of fibers, the present invention includes a dimensionally stable self-supporting housing lining structure, and attachment of the lining on supporting bodies, for instance automobile hoods, is simplified. The supporting frame can have first attachment elements which engage second attachment elements of the supporting body. A simple connection between the housing lining and the supporting body can be formed using a snap connection. The bulges result in an increase in the absorption area, the sound impedance varying between 20 and 200 Rayl, preferably between 15 and 150 Rayl—resulting in a degree of absorption which can be adjusted in a targeted manner to the frequency spectrum of the source of noise. The fibers of the present invention can, for instance, consist of cotton.

In certain areas of the layer, arranged within the supporting frame, additional fibers can be compressed and glued together to form essentially pore-free supporting elements. The supporting elements arranged within the supporting frame can be supporting webs which extend in a manner which stiffen the supporting frame, for instance in X-shaped profile. Even when using substantially pore-free supporting elements within the supporting frame, a substantial part of the housing lining consists of relatively weakly compressed fibers which produce good sound absorption of higher frequencies of more than 800 Hz. Intersecting supporting elements increase the dimensional stability of the housing lining.

An additional increase in the dimensional stability can be achieved in the manner that the bulges are arranged in the supporting frame and/or supporting element and extend parallel to the longitudinal direction of their profile. A substantially U-shaped profile of supporting frame and/or supporting element results in increased resistance to bending and twisting.

In one advantageous embodiment of the present invention, the bulges can be provided, on the side facing away from the airborne sound, at least partially with an air-tight film-like coating. The bulges provided with the coating are penetrated on the side facing the airborne sound by a passage opening, so as to form a Helmholtz resonator. The provision of integral Helmholtz resonators with the housing lining makes it possible to achieve sound absorption of different and preferably lower frequencies of less than 800 Hz. The Helmholtz resonators can be varied as to volume, diameter of their passage opening and length of the neck. Together with the bulges, which preferably have a sound impedance between 50 and 150 Rayl, sound absorption over a broad frequency range can be provided which can be adapted to the circumstances of the specific application. With a view towards easy manufacture of the housing lining, it is of great importance that the Helmholtz resonators be made integral with the fiber layer.

With a view towards a sound absorption over the greatest possible range, the bulges can cover 10%–90% of the total surface of the layer, 10%–90% of the bulges being structured as Helmholtz resonators.

The bulges which are arranged in the supporting frame and/or supporting element, can be arranged in close succession, so that the successive bulges interlock each other in the region of their end sides. In this arrangement, the regions of weakly compacted fibers located outside the supporting frame and/or supporting elements contribute to the sound absorption of higher frequencies and the regions developed as bulges contribute to the absorption of low-frequency vibrations. The bulges and their arrangement in close succession result in a large absorption area.

In order to produce interlocking, the bulges can have a essentially V-shaped profile. Adjacent bulges can thereby be brought into engagement with each other upon a deformation of the housing lining, which results in an additional stiffening. In addition to a essentially V-shaped outline, the bulges can also have a U-shaped profile. The supporting frame and/or the supporting elements can have a U-shaped profile which is open in the direction towards the carrier element whereby, together with the cup-shaped bulges, chambers are formed which can be utilized for sound absorption. The housing lining of the present invention can be cemented to any desired substrate or be clipped or bolted onto the same. The carrier element can for instance be formed by the engine hood of a motor vehicle, the housing lining being attached to the side of the engine hood facing the engine.

If the housing lining of the invention is used for instance as a ceiling lining in the passenger compartment of the car, it is possible to cover it on the side facing the source of the sound with a surface coating of porous open-pore material. This results in a further improvement of the sound absorption particularly in the higher frequency range.

BRIEF DESCRIPTION OF THE DRAWINGS

FIG. 1 is a view of a first embodiment seen from the side facing the source of sound;

FIG. 2 is a cross-section through the housing lining of FIG. 1, mounted on a carrier body;

FIG. 3 is a second embodiment shown in cross-section; and

FIG. 4 is a third embodiment, shown in cross-section, the bulges being developed in part as Helmholtz resonators.

DETAILED DESCRIPTION OF THE DRAWINGS

Figure 1:
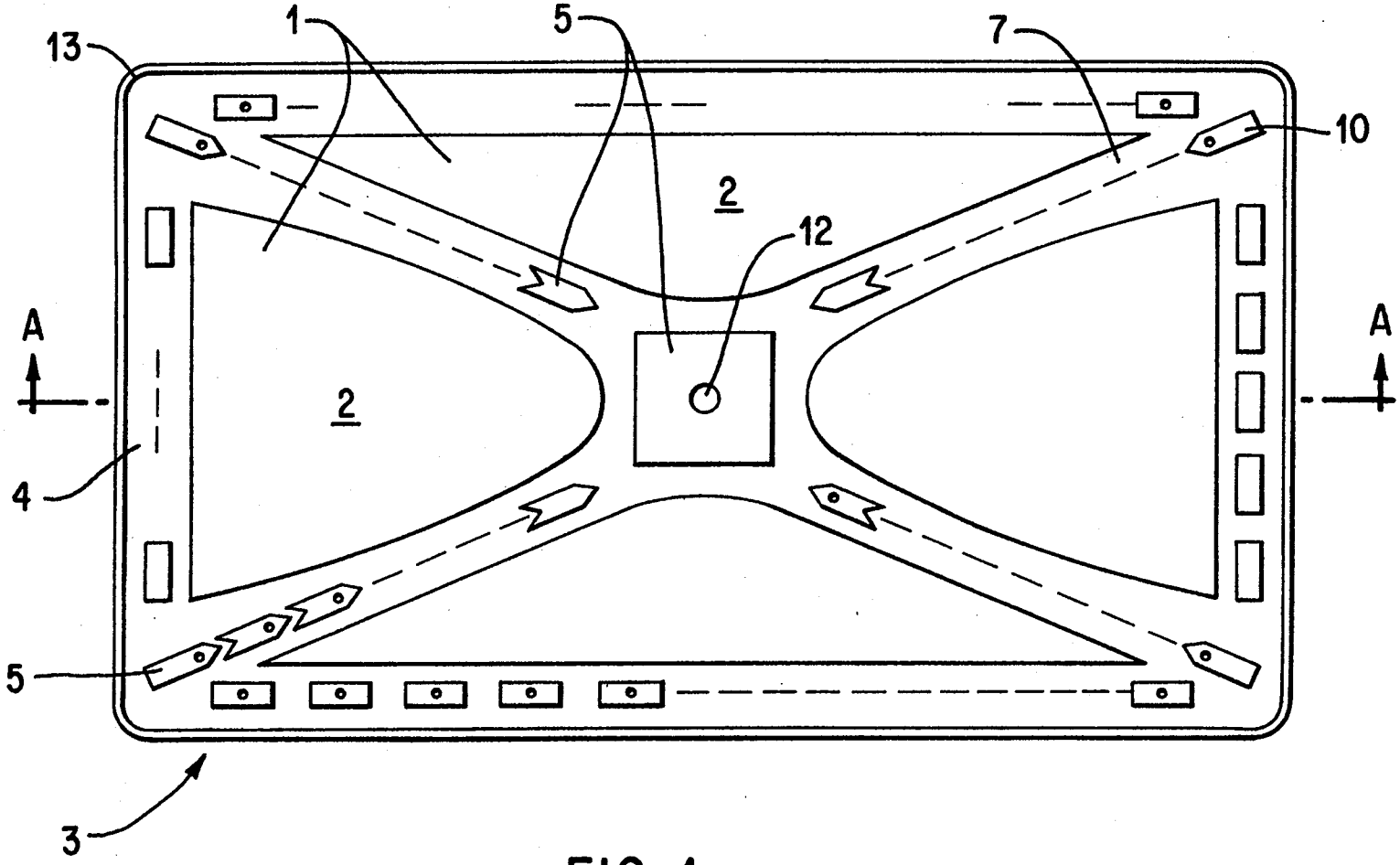
FIGS. 1–4 show embodiments of the housing lining according to the present invention which will be described in greater detail below.
Figure 2:
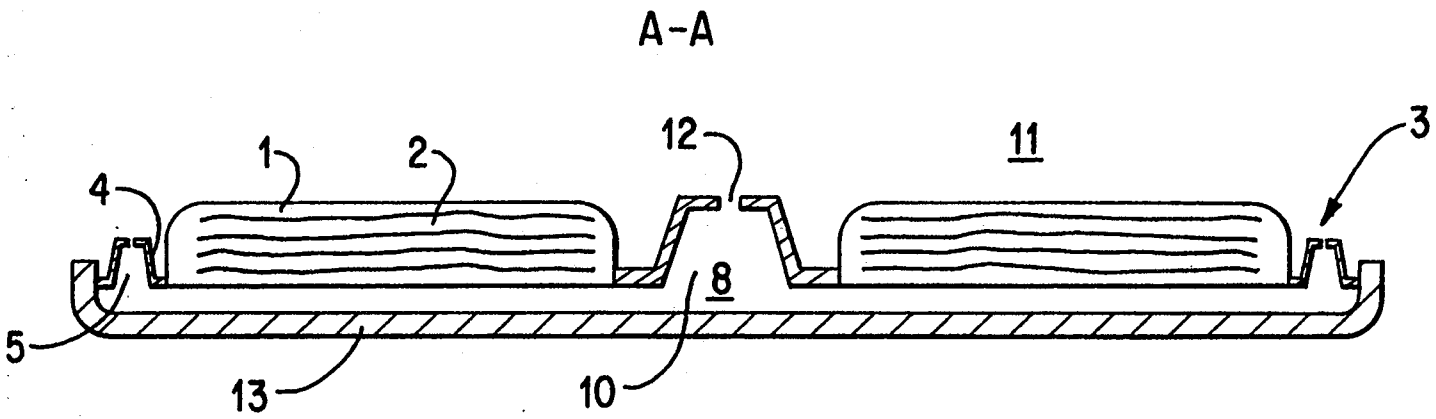

FIGS. 1 and 2 show a first embodiment of a housing lining of the present invention, which is attached to the inner side of an engine hood 13. The housing lining consists of an air-filled sound-absorbing layer 1 of fibers 2, the edge 3 of the housing lining being compressed and glued together so as to form a supporting frame 4. A cement can be used to compress and glue together the housing lining, for instance a phenol resin or a thermoplastic binder. In order to stiffen the housing lining further, in addition to the supporting frame 4, additional fibers 2, which are arranged within the supporting frame 4, are compressed and glued together to form a substantially X-shaped supporting element 7. With a view towards the greatest possible surface for the broad-band sound absorption, in the embodiment of FIGS. 1–2, both the support frame 4 and the supporting element 7 have a large number of bulges 5 which are designed in the embodiments of FIGS. 1, 2 and 4 at least in part as Helmholtz resonators 10. The Helmholtz resonators 10 are provided in each case with one passage opening 12 for air, arranged in the direction towards the sound source. The Helmholtz resonators 10 are tuned to the frequency of the airborne sound to be absorbed and have different volumes and/or opening cross sections for the passage openings 12. The bulges which are developed as Helmholtz resonators can be provided, on the side 8 facing away from the airborne sound, with an air-tight film-like coating 9 (FIG. 4) which can for instance be cemented onto the bulges 5. In the region of the passage opening 12, the coating 9 is also perforated. The bulges 5 which are not developed as Helmholtz resonators consist of compressed and glued together fibers, their absorption areas 6 having a sound impedance which lies preferably within the range from 50 to 150 Rayl. In order to achieve a sound absorption of the greatest possible range, the bulges can be provided for instance with different wall thicknesses and consequently different sound impedances.

The bulges 5 are designed to be essentially rectangular in the side facing the sound source of the supporting frame 4 and they are arranged in close succession to each other. An additional stiffening of the housing lining is achieved in the case of the embodiment according to FIG. 1 in the manner that the successive bulges 5 arranged along the supporting element 7 interlock each other in the region of their ends in V-shaped manner.

It can be noted from FIG. 2 that almost the entire surface of the housing lining facing the airborne sound is utilized for the absorption of the airborne sound. The entire housing lining is made in one piece and consists of fibers 2, which are compressed and glued together in the region of the supporting frame 4 and/or supporting element 7 so as to form bulges 5 while the regions which are not glued together consist of a layer 1 of fibers which absorb airborne sound.

Figure 3:
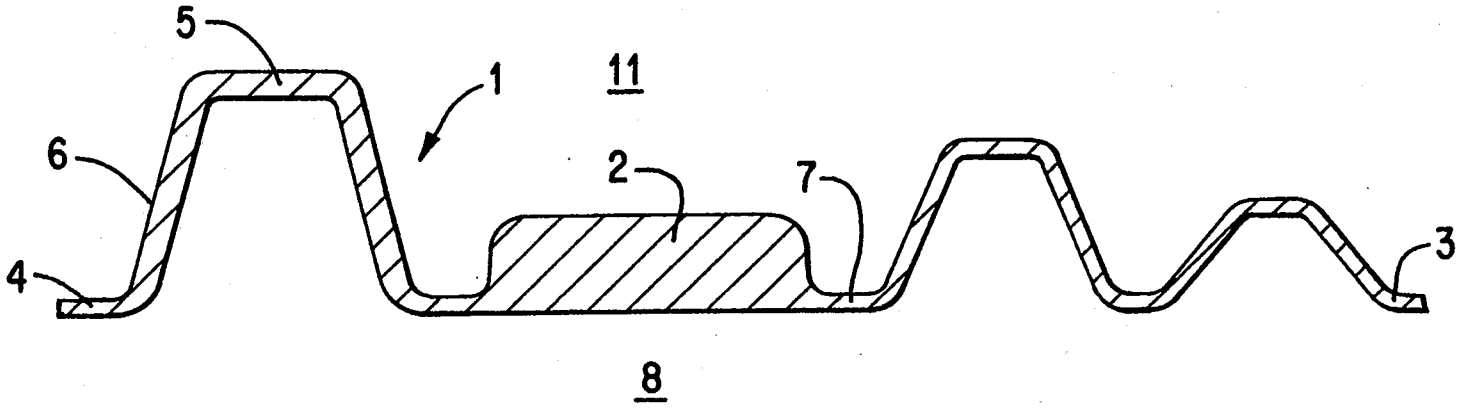

Differing from the first embodiment of FIG. 1, a second embodiment is shown in FIG. 3. The bulges 5 have different wall thicknesses, the sound impedance of the bulges 5 amounting to 50 to 150 Rayl. The large absorption surface 6 of the bulges 5 permits an airborne sound absorption within a frequency range of 50 to 10,000 Hz.

Figure 4:
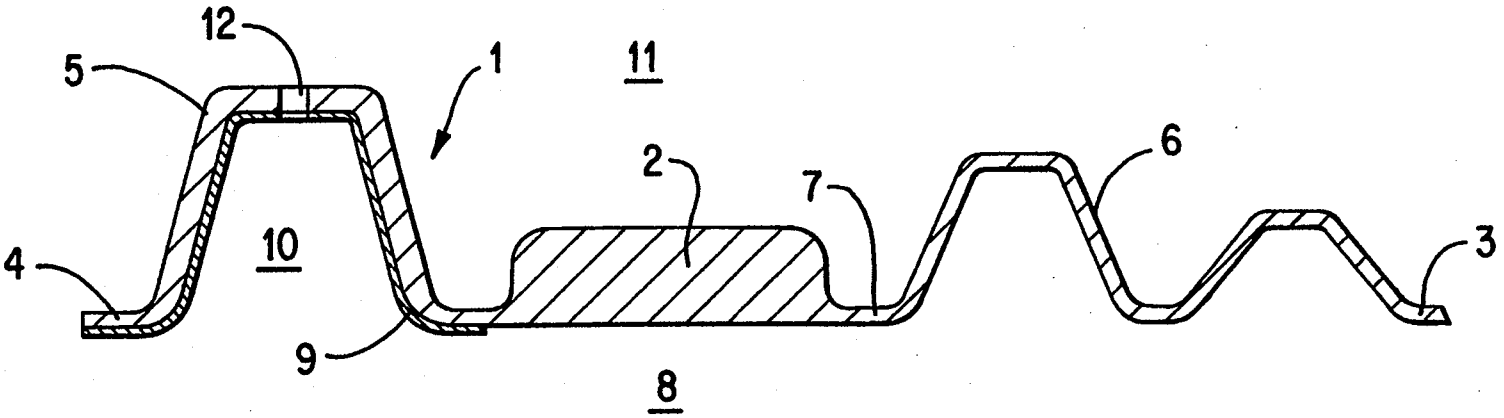

FIG. 4 is a cross section, similar to the cross section of FIG. 3, wherein, on the side 8 of the Helmholtz resonator 10 facing away from the airborne sound, there is arranged an air-tight film-like coating 9 which is perforated in the region of the passage opening 12 of the Helmholtz resonator 10. The coating 9 is present only in the area of the Helmholtz resonators 10 so that the cup-shaped bulges 5, which are closed on the side 11 facing the airborne sound, have the desired sound impedance.

We claim:

1. A housing lining comprising:

a self-supporting layer of fibers, said layer of fibers being air-filled and sound-absorbing said layer of fibers having an edge region, said fibers in said layer of fibers being compressed and glued together in said edge region to form an essentially pore-free supporting frame, said supporting frame comprising at least one cup-shaped bulge, said at least one cup-shaped bulge comprising sound absorption surfaces having a sound impedance of 20 to 200 Rayl.

2. A housing lining according to claim 1, wherein:

said sound impedance is 15 to 150 Rayl.

3. A housing lining according to claim 1, wherein:

within said supporting frame, said housing lining further comprises additional compressed and glued together fibers, said additional compressed and glued together fibers forming at least one essentially pore-free supporting element.

4. A housing lining according to claim 3, further comprising:

at least two said supporting elements, wherein said at least two supporting elements intersect.

5. A housing lining according to claim 4, further comprising:

a plurality of said cup-shaped bulges arranged in said supporting frame and in said at least two supporting elements.

6. A housing lining according to claim 5, wherein:

at least one of said cup-shaped bulges has, on one side of said at least one of said cup-shaped bulges, an air-tight film-like coating and said at least one of said cup-shaped bulges with said coating has a passage therethrough, to thereby form a Helmholtz resonator.

7. A housing lining according to claim 5, wherein:

said cup-shaped bulges cover 10%–90% of a total surface area of said layer of fibers and wherein 10%–90% of said cup-shaped bulges have a passage therethrough to thereby form Helmholtz resonators.

8. A housing lining according to claim 5, wherein:

said cup-shaped bulges of said supporting frame are arranged closely adjacent one another, and said cup-shaped bulges of said at least two supporting elements comprising end sides, successive bulges interlocking with each other in a region of said end sides.

9. A housing lining according to claim 8, wherein: said cup-shaped bulges of said at least two supporting elements have an essentially V-shaped outline at said end sides, said V-shaped outline allowing said interlocking.

* * * * *